United States Patent [19]

Gregory et al.

[11] Patent Number: 4,878,781

[45] Date of Patent: Nov. 7, 1989

[54] MOISTURE CONTROL SYSTEM FOR A FOUNDATION

[76] Inventors: Steven D. Gregory, 425 Sheffield, Richardson, Tex. 75081; Joseph R. Holler, 5616 Spring Valley Rd., Apt. 125, Dallas, Tex. 75240

[21] Appl. No.: 280,377

[22] Filed: Dec. 6, 1988

[51] Int. Cl.[4] ..... E02B 11/00

[52] U.S. Cl. ..... 405/52; 405/36; 405/51; 52/169.5; 52/169.14

[58] Field of Search ..... 405/43, 36, 44, 45, 405/51, 39, 42, 48, 52; 52/169.5, 169.14

[56] References Cited

U.S. PATENT DOCUMENTS 444,564 1/1891 Copeland .
584,886 6/1897 Mead .
888,217 5/1908 Bishop ..... 405/43 X
1,355,222 10/1920 French ..... 405/51
3,046,747 1/1959 Timpe .
4,534,143 8/1985 Goines et al. ..... 405/45 X

*Primary Examiner*—Dennis L. Taylor
*Assistant Examiner*—J. Russell McBee
*Attorney, Agent, or Firm*—Warren B. Kice

[57] ABSTRACT

A moisture control system for controlling the moisture level of subsoil adjacent the foundation of a building in which a supply pipe extends in the subsoil along an area adjacent the foundation and an accumulator pipe is disposed adjacent the supply pipe. A plurality of porous pipes are each connected between the supply pipe and the accumulator pipe and are adapted to allow seepage of water into the subsoil.

7 Claims, 2 Drawing Sheets

MOISTURE CONTROL SYSTEM FOR A FOUNDATION

BACKGROUND OF THE INVENTION

This invention relates to a moisture control system and, more particularly, to such a system for controlling the moisture level in an area surrounding a building foundation.

The shrinking or swelling of subsurface soil around the foundation of a building as a result of differing moisture conditions in the soil can cause severe damage to the foundation of the building. For example, in certain situations moisture builds up in the subsoil directly underneath the foundation, but in the areas surrounding this moist control area, which is usually underneath the perimeter of the foundation, the subsoil is relatively dry thus creating an inconsistent moisture profile across the entire area beneath the foundation. Since soil tends to swell when moist and shrink when dry it can be appreciated that subsoils of these types bearing the weight of a foundation will cause differential foundation movement and attendant failures.

SUMMARY OF THE INVENTION

It is therefore an object of the present invention to provide a moisture control system for an area immediately below a building foundation which ensures a substantially equal moisture content of the soil below the foundation and an attendant reduction in differential foundation movement.

It is a further object of the present invention to provide a moisture control system of the above type in which moisture is applied to the relative dry areas underneath the building foundation to equalize the moisture content across the profile of the area below the foundation and minimize differential foundation movement.

It is a further object of the present invention to provide a moisture control system of the above type in which the degree of moisture introduced to the subsoil below the foundation can be varied in accordance with particular climate conditions.

Toward the fulfillment of these and other objects, the moisture control system of the present invention includes a plurality of supply pipes extending in the subsoil along an area adjacent the building foundation. A plurality of accumulator pipes are disposed adjacent the supply pipes and a plurality of porous hoses are connected between the supply pipes and the accumulator pipes for allowing seepage of water into the subsoil.

DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
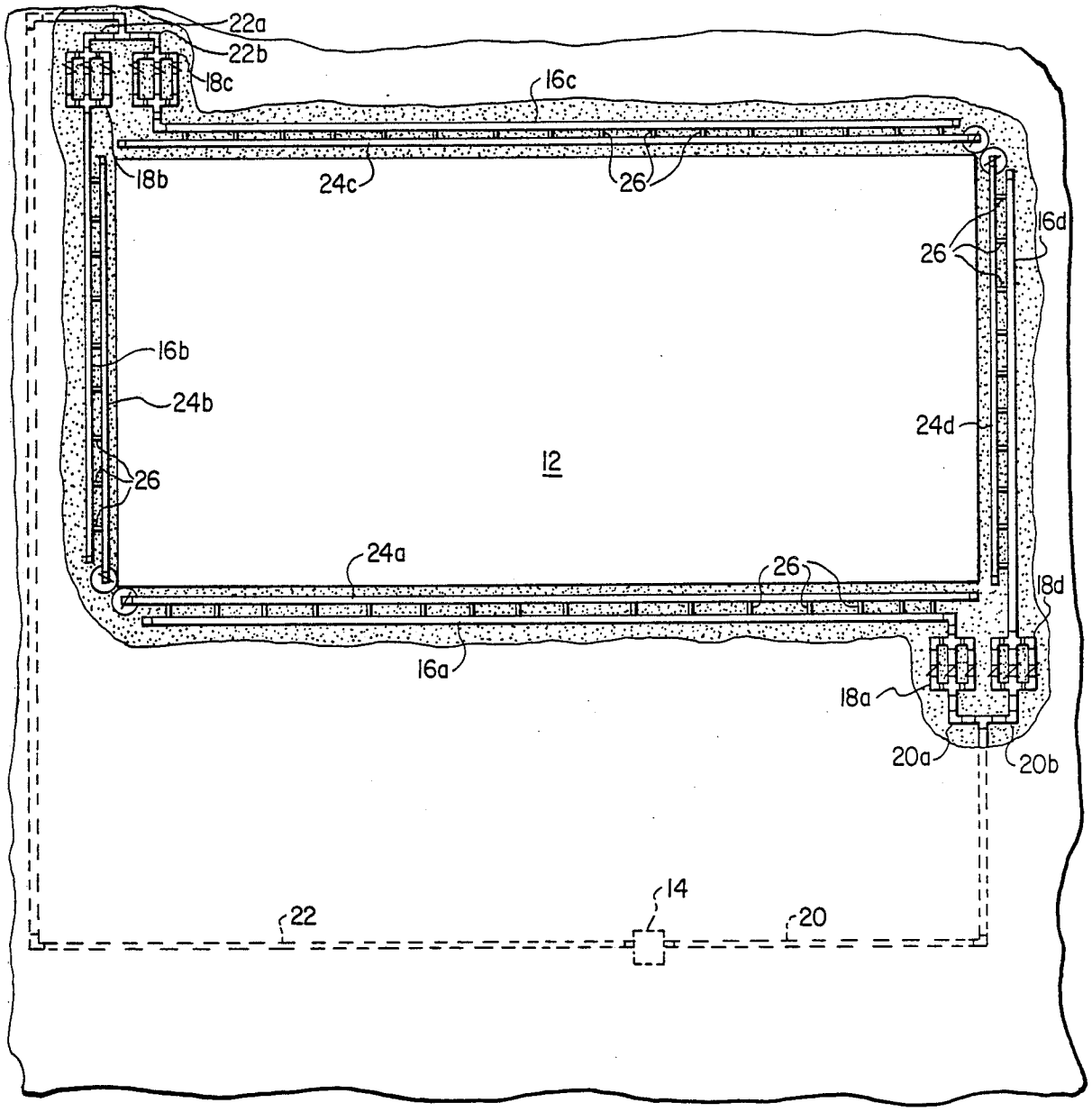
FIG. 1 is a plan view of the moisture control system of the present invention shown installed below the foundation of a building.

Referring specifically to FIG. 1 of the drawings, the reference numeral 12 refers, in general, to a foundation of a building such as a house, office building, or the like. The building is normally serviced by a water main 14 which is directly connected to the normal water supply for the interior of the building by a piping system (not shown).

According to the present invention, four supply pipes 16*a*, 16*b*, 16*c* and 16*d* are respectively disposed immediately adjacent the front wall, the rear wall and the two side walls of the housing and are disposed at a predetermined distance underneath ground level, such as two feet. Manifolds 18*a*, 18*b*, 18*c* and 18*d* are connected to the supply pipes 16*a*, 16*b*, 16*c* and 16*d*, respectively and function in a manner to be described in detail later. The water main 14 is connected to the manifolds 18*a* and 18*d* by a pipe 20 having two branch conduits 20*a* and 20*b*; and to the manifolds 18*b* and 18*c* by a pipe 22 having two branch conduits 22*a* and 22*b* respectively. The manifolds 18*a*–18*d* are connected to the supply pipes 16*a*–16*d*, respectively in a manner to be described.

Four accumulator pipes 24*a*, 24*b*, 24*c* and 24*d* extend parallel to, and slightly spaced from, the supply pipes 16*a*, 16*b*, 16*c* and 16*d*, respectively. A plurality of porous pipes 26 extend between each supply pipe 16*a*–16 *d* and its corresponding accumulator pipe 24*a*–24*d*, respectively, for reasons that will be described in detail. The porous pipes are substantially U shaped and extend approximately five feet downwardly into the subsoil from the level of the supply pipes 16*a*–16*d*.

Water from the main 14 is thus passed, via the pipes 20 and 22, to the manifolds 18*a*–18*d* and from the latter, to the supply pipes 16*a*–16*d*. Water from the supply pipes 16*a*–16*d* passes into and through the porous pipes 26 for discharge into the subsoil, and the excess water passes into the accumulator pipes 24*a*–24*d*.

Figures 2, 3:
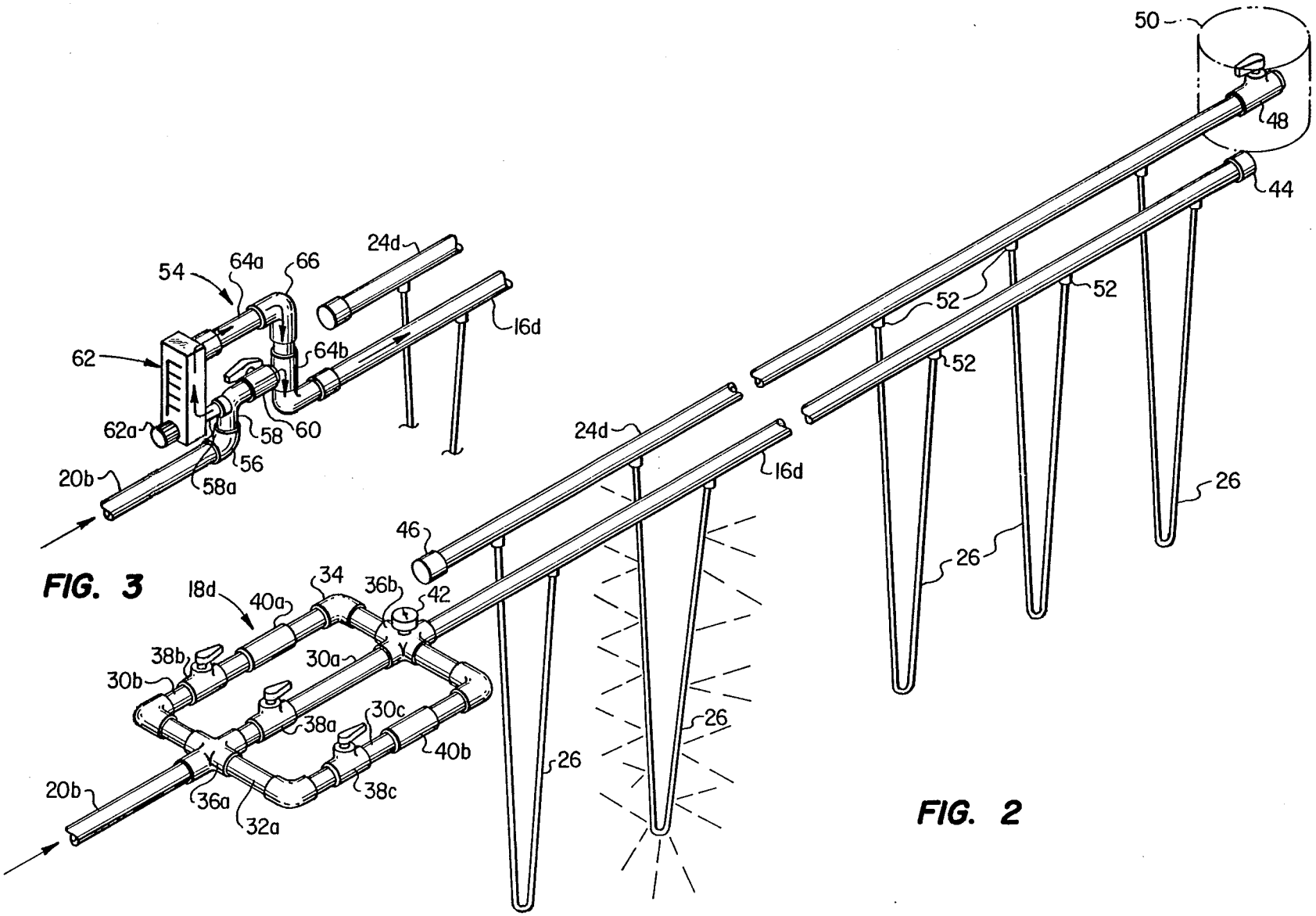
FIG. 2 is a perspective view of the moisture control system of the present invention.
FIG. 3 is a perspective view of an alternate embodiment of the manifold used in the moisture control system of FIGS. 1 and 2.

FIG. 2 depicts the manifold 18*d* in greater detail, it being understood that the other manifolds 18*a*, 18*b* and 18*c* are constructed and function in an identical manner. More particularly, the manifold 18*d* comprises three parallel pipes 30*a*, 30*b* and 30*c* disposed in a spaced, parallel relationship and extending between two header pipes 32*a* and 32*b*. Four "elbow" fittings 34 are provided at the connecting ends of the aforementioned pipes, a X-fitting 36*a* connects the pipe 20*b* with the pipes 30*a* and 32*a*, and a X fitting 36*b* connects the pipe 30*a* to the pipes 32*b* and 16*d*.

Three "on-off" ball valves 38*a*, 38*b* and 38*c* are associated with the pipes 30*a*, 30*b* and 30*c*, respectively, and two flow regulators 40*a* and 40*b* are mounted in the pipes 30*b* and 30*c*, respectively, for controlling the flow of water therethrough, as will be described. A pressure gauge 42 is provided on the fitting 36*b* to provide a visual indication of the water pressure in the system as also will be described. Although the pipes 30*a*, 30*b*, 30*c*, 32*a* and 32*b* have been described as being a single pipe it can be appreciated that they actually comprise two or more segments to accommodate the fittings 34, 36*a* and 36*b*, the valves 38*a*, 38*b* and 38*c* and the flow regulators 40*a* and 40*b*.

The supply pipe 16*d* is connected at one end to the fitting 36*b* and its other end is closed by a cap 44. The accumulator pipe 24d has a cap 46 closing one end thereof and a purge valve 48 disposed on the other end thereof. A casing, or box, 50 extends around the purge valve 48 to protect same from the soil. It is understood that the supply pipes 16a–16c and the accumulator pipes 24a 24c are constructed and arranged in a manner identical to that of the pipes 16d and 24d.

The respective ends of each porous pipe 26 is connected, by the appropriate fittings 52, to their corresponding supply pipes 16a–16d and accumulator pipes 24a–24d in a conventional manner. The porous pipes 26 can be fabricated of any type conventional material which enables a precontrolled amount of the water introduced into the pipe to seep outwardly through the pipe and into the subsoil. An example would be a pipe marketed under the trademark "Leaky Pipe" which is a porous pipe or hose fabricated from rubber or plastic particles in a manner so that the pipe will permit seepage of water through the pores in the pipe when the pipe is connected to water under pressure. Any excess water will be transmitted to the accumulator pipe 24d.

In operation, the flow regulator 40a is preset to permit a predetermined relatively high flow of water therethrough based on the relative hot and/or dry season of the year, while the flow regulator 40b is set for a relatively low flow of water based on a cooler and/or less dry season. The ball valve 38a is turned off, one of the ball valves 38b and 38c is turned on and the other turned off according to the particular season. Assuming a relative hot and/or dry season, the valve 38b would be turned on and the valve 38a and 38c turned off and water from the main 14 would pass through the lines 20 and 20b into the header pipe 32a of the manifold 18d and into and through the pipe 30b. From the pipe 30b the water enters the header pipe 32b and exits, via the fitting 36b, to the supply pipe 16d. The water passes from the supply pipe 16d into the porous tubes 26 and seeps from the later to moisturize the subsoil in which the tubes are embedded, with any excess water passing into the accumulator pipe 24d.

It can be appreciated that manifolds 18a–18d and their associated supply pipes, accumulator pipes and porous tubes function in a manner identical to that just described in connection with the manifold 18d and its associated piping.

The system can be adjusted for a less hot and less dry season by opening the ball valve 38c and closing valve 38b so that a lower amount of water passes through the pipe 30c an into the supply pipe 16d. The system can be periodically "purged" by closing the ball valves 38b and 38c and opening the ball valve 38a and the valve 48. This permits water at very high flow to pass through the system and purge the system of any foreign material, etc.

It is thus seen that the system of the present invention provides an effective system for controlling the moisture content around the periphery of the foundation and therefore to stabilize the moisture profile of the subsoil throughout the entire area below the foundation 12.

FIG. 3 depicts an alternate embodiment of the manifold 18d utilized in the moisture control system of FIGS. 1 and 2. The manifold of FIG. 3 is referred to in general by the reference numeral 54 and consists of an elbow fitting 56 connected at one end to the branch conduit 20b and a pipe 58 connected to the other end of the elbow fitting 56. The pipe 58 is connected to an "on-off" ball valve 60. A branch pipe 58a connects the pipe 58 to a variable control valve 62 whose outlet is connected, via pipe segments 64a and 64b and an elbow fitting 66, to the supply pipe 16d. The outlet of the valve 60 is connected to the pipe segment 64b. The control valve 62 includes a knob 62a which can be manually adjusted to vary the flow of water through the valve.

The valve 60 is normally closed to direct the flow of water through the valve 62, the pipe segments 64a and 64b and the fitting 66 to the supply pipe 16d. The water flow is regulated by the valve 62 in accordance with the type of season, as discussed above. To purge the system, the control valve 60 is opened and the water flow is directed directly from the branch conduit 20b through the valve 60 and to the supply conduit 16d, as discussed above.

Thus the manifold 54 operates in a similar manner to the manifold 18d with the valve 62 being manually adjusted to control the fluid flow therethrough in accordance with the fluid demand based on the particular seasons.

It is understood that, according to the embodiment of FIG. 3, the manifold 54 would also replace the manifolds 18a, 18b and 18c of the embodiments of FIGS. 1 and 2.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A moisture control system for controlling the moisture level of subsoil adjacent the foundation of a building comprising a source water, supply pipe means extending in said subsoil along an area adjacent said foundation and connected to said water source, accumulator pipe means disposed adjacent said supply pipe means, and a plurality of generally U-shaped porous pipes each extending away from and substantially orthogonal to said supply pipe means and said accumulator pipe means, and each being connected between said supply pipe means and said accumulator pipe means for receiving water from said supply pipe means and allowing said water to seep out into said subsoil, said accumulator pipe means adapted to receive the water from said porous pipes that does not seep therefrom.

2. The system of claim 1 further comprising manifold means connected between said water source and said supply pipe means, said manifold means comprising means for supplying different quantities of water to said supply pipe means.

3. The system of claim 2 wherein said manifold means comprises two pipes for respectively supplying different quantities of water to said supply pipe means and means for selectively routing water to said two pipes.

4. The system of claim 2 wherein said manifold means comprises a variable flow control valve for varying the flow of water therethrough.

5. The system of claim 2 wherein said manifold means comprises means for introducing water to said supply pipe means at a relatively high pressure to purge said supply pipe means.

6. The system of claim 1 further comprising means for purging said accumulator pipe means of the water accumulated therein.

7. The system of claim 6 wherein said purge means comprises an on-off valve disposed at one end of said accumulator pipe means, and further comprising means for closing the other end of said accumulator pipe means.

* * * * *